US006809273B2

(12) United States Patent
Ito et al.

(10) Patent No.: US 6,809,273 B2
(45) Date of Patent: Oct. 26, 2004

(54) SWITCH STRUCTURE

(75) Inventors: Masahiro Ito, Kariya (JP); Yasuhiko Yamazaki, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/611,152

(22) Filed: Jul. 1, 2003

(65) Prior Publication Data

US 2004/0003986 A1 Jan. 8, 2004

(30) Foreign Application Priority Data

Jul. 8, 2002 (JP) ..... 2002-198681

(51) Int. Cl.[7] ..... H01H 9/00; H01H 21/80; H01H 23/02

(52) U.S. Cl. ..... 200/5 R; 200/315; 200/343; 200/344

(58) Field of Search ..... 200/5 R, 5 A, 200/6 R, 6 A, 17 R, 18, 293–296, 314–316, 341–344

(56) References Cited

U.S. PATENT DOCUMENTS 4,029,925 A * 6/1977 Biske ..... 200/339
5,560,475 A * 10/1996 Brundage et al. ..... 200/315
5,712,459 A * 1/1998 Ziegler ..... 200/5 R
5,803,240 A * 9/1998 Swidersky et al. ..... 200/344
6,384,355 B1 * 5/2002 Murphy et al. ..... 200/344
6,492,605 B2 * 12/2002 Iida ..... 200/343
6,570,111 B2 * 5/2003 Nakagawa et al. ..... 200/343
2001/0047927 A1 12/2001 Ogawa et al.

FOREIGN PATENT DOCUMENTS

| | | |
|---|---|---|
| JP | 5-6563 | 1/1993 |
| JP | 5-90772 | 12/1993 |
| JP | 7-41919 | 7/1995 |
| JP | 2001-345030 | 12/2001 |

* cited by examiner

*Primary Examiner*—James R. Scott
(74) *Attorney, Agent, or Firm*—Harness, Dickey & Pierce, PLC

(57) ABSTRACT

A switch structure comprising a switch element (5, 59, 61) performing circuit switching operation by pushing and a push button section (3) attached rotationally movably to a supporting member (7, 91) and having a push rod section (25, 77, 81) pushing the switch element and integrally formed thereto, wherein a switching operation is performed when the push button section (3) is rotationally moved by pushing and push rod section pushes the switch element, wherein the push rod section is provided with a flexible portion (27) able to bend when pushed, and wherein a guide section (47, 57, 49) is provided which comes into contact with the push rod section to bend the flexible portion and, at the same time, guides the push rod section to push the switch element in the normal direction when the push button section is rotationally moved by pushing.

12 Claims, 9 Drawing Sheets

Fig. 12 PRIOR ART
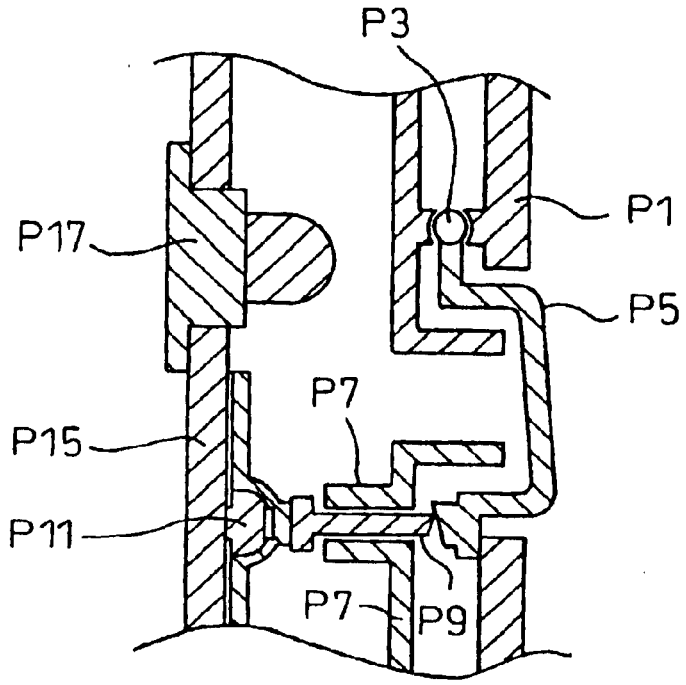
Fig. 13 PRIOR ART
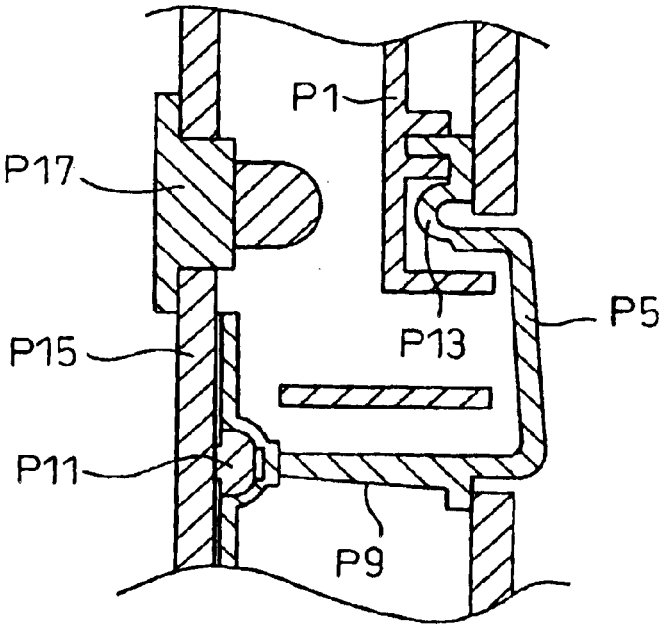

Fig. 14 PRIOR ART
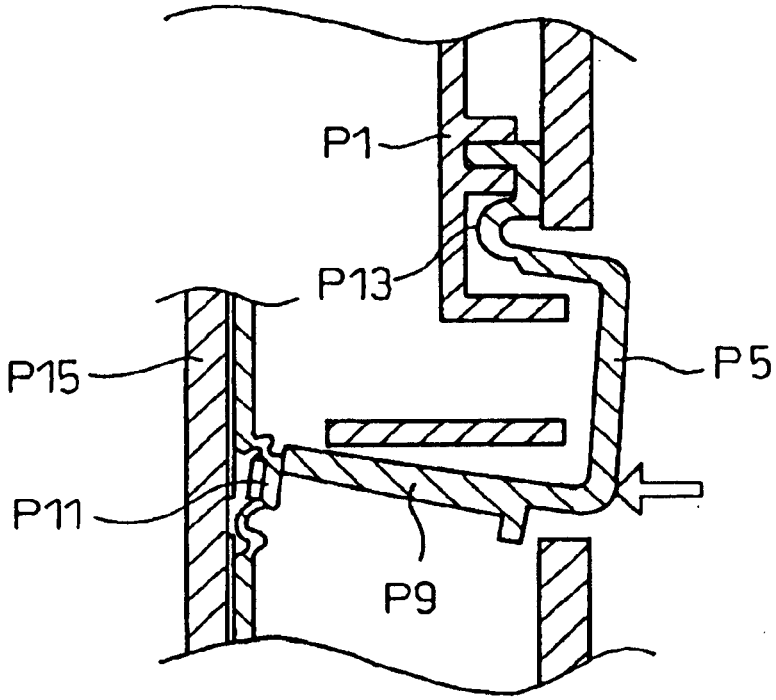

SWITCH STRUCTURE

BACKGROUND OF THE INVENTION

1. Field of the Invention

The present invention relates to a switch structure used in an operation switch panel for an air conditioner, an audio system, and so on, for a vehicle.

2. Description of the Related Art

Conventionally, a switch structure shown in FIG. 12 is used in an operation switch panel for an air conditioner, an audio system, and so on, for a vehicle.

The switch comprises a push button section P5 attached to a supporting member P1 in such a way that the push button section P5 can pivot around a pivot shaft P3 as a center, a push rod section P9 pushed inward by the push button section P5 while being guided by a guide section P7 when the push button section P5 pivots, and a switch element P11 that is turned on and off by the push rod section P9 pushed inward.

Another switch structure shown in FIG. 13 comprises a push button section P5 formed integrally with the push rod section P9 while being pivotally attached to the supporting member P1 via a hinge P13 and a switch element P11 that is turned on and off by the push rod section P9.

In these switch structures, the back of the push button section P5 is generally illuminated by a light source section P17 attached to a substrate P15 for night illumination, but the light source section P17 are often shared with a plurality of switch structures to reduce the manufacturing cost of the switch.

In these cases, the light source section P17 is, as a consequence, installed at a position away from the position directly under the push button section P5 so that other switch structures are also illuminated and, therefore, the distance between the substrate P15 and the push button section P5 is large so that a light path from the light source section P17 to the back of the push button section P5 is ensured.

However, in the switch structure shown in FIG. 12, as the push rod section P9 and the push button section P5 are separate parts, there is the cost of the part, a die and assembly for each part, resulting in a rise in the manufacturing cost. Moreover, a problem occurs that a sound of parts returning into place is produced between the push button section P5 and the push rod section P9, resulting in a loss of excellent feel of the switch.

In the switch structure shown in FIG. 13, as the push rod section P9 is formed integrally with the push button section P5, the movement of the push rod section P9, while the push button section P5 pivots, is not a linear one toward the switch element P11 but a pivot movement about the hinge P13 as a center.

As a consequence, as shown in FIG. 14, when the push button section P5 pivots and the push rod section P9 pushes in the switch element P11, the push rod section P9 tilts with respect to the switch element P11 and the tip of the push rod section P9 is offset from the center of the switch element P11. Particularly when the distance between the substrate P15 and the push button section P5 is set large in order to ensure the light path from the light source section P17 to the push button section P5 and, accordingly, the push rod section P9 is long, the amount of the offset amount is large.

As described above, if the push rod section P9 tilts with respect to the switch element P11 or the tip of the push rod section P9 is offset from the center of the switch element P11, a problem occurs that the contact point of the switch element P11 does not conduct electricity or that the operability is marred.

Moreover, if the operating stroke of the push button section P5 is shortened, the problem of the offset of the push rod section P9 can be resolved to a certain extent but in this case another problem occurs that the operability of the switch is marred.

The present invention has been developed with the above-mentioned problems being taken into consideration and the object is to provide a switch structure, the manufacturing cost of which is low, which operates stably, and the operability and the excellent feel are maintained.

According to a first aspect of the present invention, a push rod section is provide with a flexible portion and when a push button section is pushed and moves rotationally, the push rod section comes into contact with a guide section and bends the flexible portion and at the same time the push rod section is guided by the guide section and pushes a switch element.

Due to the rotational movement of the push button section, the push rod section comes into contact with the guide section and bends the flexible portion of the push rod section even if the push rod section as a whole tilts with respect to the switch element and, therefore, the switch element can be securely turned on and off and excellent operability can be obtained.

Moreover, as the push rod section is integrated with the push button section as a part thereof, the manufacturing cost can be reduced compared to a case where the push rod section is manufactured as a separate part. In addition, it is unlikely that a sound of parts returning into place is produced between the push button section and the push rod section or that the excellent feel of the switch structure is marred.

When the push rod section pushes the switch element, the angle of a contact portion (the vicinity of the portion that comes into contact with the switch element) of the push rod section with respect to the direction of movement of the switch element is within the range in which the effects of the present invention (that is, the push rod section can securely turn on and off the switch element and the operability is excellent) can be obtained (for example, the contact portion of the push rod section is in parallel with the direction of movement of the switch element).

According to a second aspect of the present invention, as a push button section is attached to a supporting member via a hinge, it is possible to move the push button section rotationally about the hinge as a center by pushing part of the push button section.

According to a third aspect of the present invention, as the distance in the pushing direction between a flexible portion of a push rod section and a switch element is almost equal to the distance between a hinge and the switch element, it is unlikely that the flexible portion bends considerably (compared to a case where the flexible portion is nearer to the switch element than to the hinge) when a push button section pivots. Due to this, the pivot movement of the push button section does not require a large operating force and therefore excellent operability can be obtained.

In addition, as the amount of flexure at the flexible portion is small, it is unlikely that a large stress is exerted on the flexible portion and therefore the durability of the push rod section is improved.

The pushing direction in this case is reffered to, for example, a direction in which the push button section is pushed or a direction in which the push rod section pushes the switch element.

According to a fourth aspect of the present invention, as a push button section is attached pivotally to a supporting member, it is possible to make the push button section pivot around a pivot shaft as a center by pushing part of the push button section.

According to a fifth aspect of the present invention, as the distance in the pushing direction between a flexible portion of a push rod section and a switch element is almost equal to the distance between a shaft of rotational movement and the switch element, it is unlikely that the flexible portion bends considerably (compared to a case where the flexible portion is nearer to the switch element than to the shaft of rotational movement) when a push button section pivots. Due to this, the pivot movement of the push button section does not require a large operating force and therefore excellent operability can be obtained.

In addition, as the amount of flexure at the flexible portion is small, it is unlikely that a large stress is exerted on the flexible portion and therefore the durability of the push rod section is improved.

In a sixth aspect of the present invention, a flexible portion is illustrated. As the flexible portion according to the present invention smoothly produces flexure when, for example, a push rod section is pressed to a guide section, the push rod section is pressed, for example, against the guide section tightly and positioned at an angle determined by the guide section.

Therefore, the switch structure of the present invention operates smoothly and excellent operability can be obtained.

According to a seventh aspect of the present invention, as a guide section is provided only on the side on which a pushing force of a push rod section is exerted when a push button section is pushed, a frictional force produced between the push rod section and the guide section is small. Therefore, the switch structure according to the present invention can operate smoothly and excellent operability can be obtained.

According to an eighth aspect of the present invention, as guide sections are provided on the side on which a pushing force of a push rod section is exerted when a push button section is pushed and on the other opposite side, with the push rod section being in between, the push rod section can be guided more securely.

According to a ninth aspect of the present invention, as the push button sections are connected to each other, it is only necessary to install the connected push button sections instead of installing each push button section respectively. Therefore, the switch structure according to the present invention can be manufactured with ease.

In addition, as a switch element and a guide section are provided corresponding to each push button section, it is possible for each switch to operate independently.

According to a tenth aspect of the present invention, the light irradiated by a light source section is guided to a push button section by a reflecting surface provided at a guide section. Therefore, as the switch structure according to the present invention does not require a light reflecting member to be provided separately, manufacturing is easy and the manufacturing cost can be reduced.

According to an eleventh aspect of the present invention, as a supporting member and a guide section are formed integrally, it is not necessary to install them as separate parts.

Therefore, the manufacture of the switch structure according to the present invention is easy and the manufacturing cost can be reduced.

According to a twelfth aspect of the present invention, as one switch structure is able to turn on and off two switch elements A and B, the manufacturing cost can be reduced compared to a case where two switch structures are provided. In addition, the space for installation of the switch structure can be reduced.

The present invention may be more fully understood from the description of preferred embodiments of the invention set forth below, together with the accompanying drawings.

BRIEF DESCRIPTION OF THE DRAWINGS

In the drawings:

FIG. 12 is a diagram illustrating the structure of a conventional switch structure.

FIG. 13 is a diagram illustrating the structure of another conventional switch structure.

FIG. 14 is a diagram illustrating the operations of the conventional switch structure.

DESCRIPTION OF PREFERRED EMBODIMENTS

Next, the embodiments of the switch structure according to the present invention are described below. First, the switch structure in the first embodiment is described by reference to FIG. 1 to FIG. 4. Here, FIG. 1 is an external view of a switch panel of an air conditioner for a vehicle, FIG. 2 is a sectional side elevation of a switch structure, and FIG. 3 and FIG. 4 are perspective views of the parts making up the switch structure.

Figure 1:
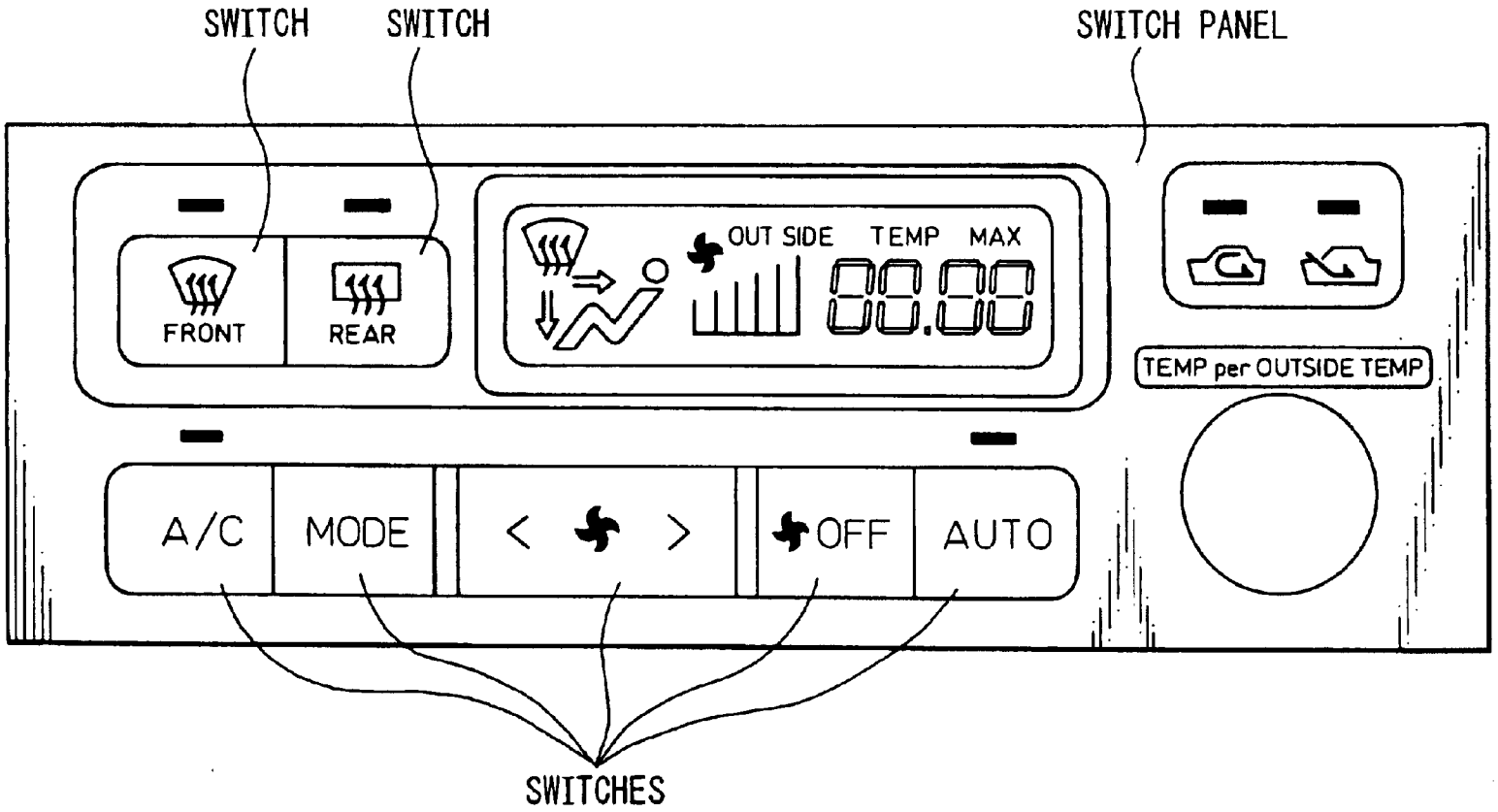
FIG. 1 is a diagram illustrating a switch panel equipped with a switch structure.

The switch structure in the first embodiment is used as a switch panel of an air conditioner for a vehicle shown in FIG. 1. The switch panel comprises a plurality of switches (such as a fan switch) for directing various operations of the air conditioner, and the switch structure in the first embodiment is used in these switches.

Figure 2:
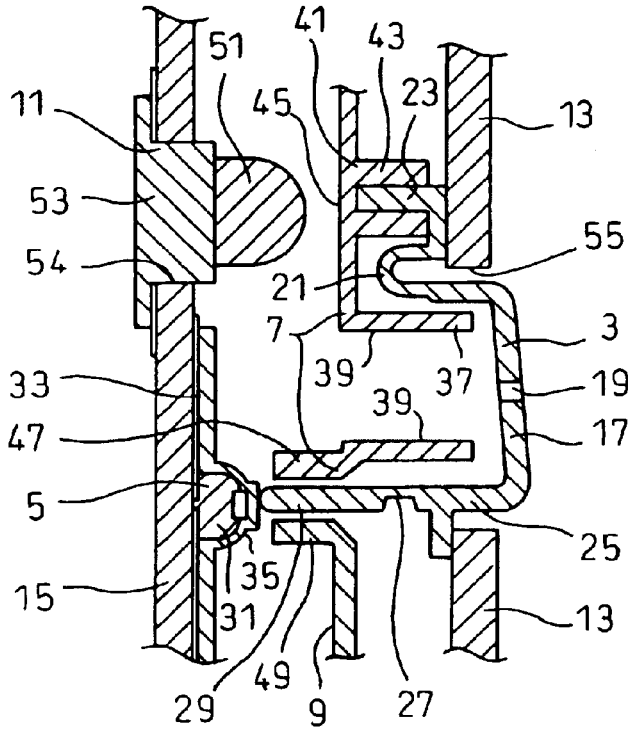
FIG. 2 is a diagram illustrating the structure of a switch structure in a first embodiment.

As shown in FIG. 2, the switch structure in the first embodiment comprises a push button section 3 that pivots when pushed, a switch element 5 that is mechanically turned on and off by the push button section 3, a supporting member 7 that supports the push button section 3 and, at the same time, that has a guide section 47 guiding the operation of the push button section 3 from inside, an external guide section 9 that guides the operation of the push button section 3, a light source section 11 that illuminates the push button section 3, a cover 13 that covers the surface of the switch structure, and a substrate 15 that supports the switch element 5 and the light source section 11.

Figure 3:
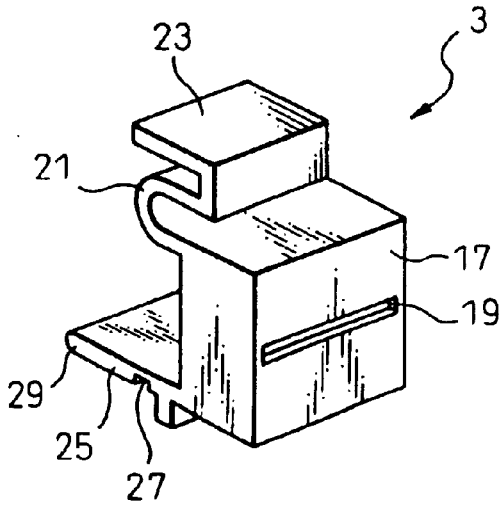
FIG. 3 is a diagram illustrating the structure of a push button section in the switch structure in the first embodiment.
Figure 4:
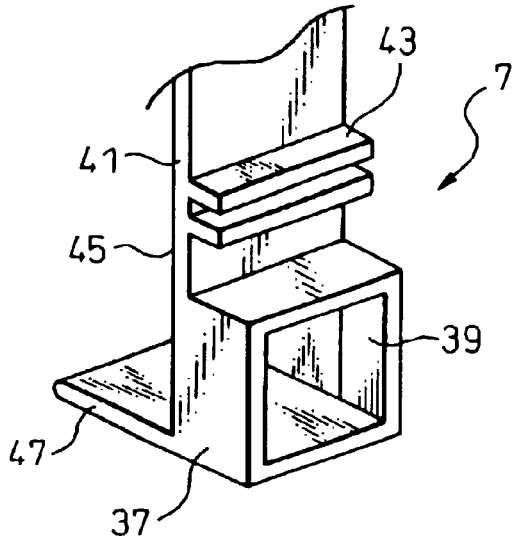
FIG. 4 is a diagram illustrating the structure of a supporting member in the switch structure in the first embodiment.

As shown in FIG. 3, the push button section 3 comprises a push portion 17 that is a hollow box-shaped member. The push portion 17 is provided with a light transmitting section 19, which is a window that allows the light from the light source section 11 to pass through, on its front side (right-hand side in FIG. 2).

In addition, the push button section 3 comprises a hinge 21 provided at one end of the push portion 17 and a fixed end 23 that is a plate-like member provided at the opposite side of the push portion 17 with respect to the hinge 21.

Moreover, the push button section 3 comprises a push rod section 25 that is a plate-like member provided in a state of being perpendicular to the substrate 15 at the end opposite to the hinge 21 of the push portion 17. The push rod section 25 is provided with a flexible portion 27, the rigidity of which is reduced by decreasing its thickness to less than that of the surrounding portion. The distance between the flexible portion 27 and the substrate 15 is set almost equal to the distance between the hinge 21 and the substrate 15. A contact portion 29, which is the tip of the push rod section 25, is sandwiched by the supporting member 7 and the external guide section 9.

The switch element 5 comprises a semi-spherical switch main body 31 provided on the substrate 15 and a rubber section 33 that covers the switch main body 31. The rubber section 33 comprises a semi-spherical dome portion 35 corresponding to the shape of the switch main body 31 and the dome portion 35 covers the switch main body 31.

The switch main body 31 of the switch element 5 is located on the extension line of the push rod section 25 and when the push rod section 25 pushes the front side (the right-hand side in FIG. 2) of the dome portion 35, the on and off states of the switch main body 31 are switched.

As shown in FIG. 2 and FIG. 4, the supporting member 7 is a cylindrical member, the sectional view of which is substantially square and comprises a main body section 37 contained inside of the push portion 17. On the inner surface of the main body section 37, a reflecting surface 39 that reflects light from the light source section 11 is provided.

In addition, the supporting member 7 comprises a supporting portion 41 extendedly provided upwardly (upward in FIG. 2) from one end of the main body section 37. There is provided an insertion portion 43 composed of two plate-shaped members erectly provided in parallel to each other on the front side of the supporting portion 41, and the fixed end 23 of the push button section 3 is inserted into the insertion portion 43. There is provided a scattering surface 45 that scatters the light from the light source section 11 on the back (left-hand side surface in FIG. 2) of the supporting portion 41.

Moreover, the supporting member 7 comprises an internal guide plate 47 (guide section) that is a plate-shaped member erectly provided in a direction perpendicular to the substrate 15 (in parallel to the push rod section 25) at the end opposed to the supporting portion 41 of the main body section 37.

The external guide section 9 comprises an external guide plate 49 that is a plate-shaped member provided under the push rod section 25 and in parallel thereto. The external guide plate 49 and the internal guide plate 47 of the supporting member 7 sandwich the contact portion 29 of the push rod section 25 from both sides while leaving a space in which the push rod section 25 can slide.

The light source section 11 comprises a lamp 51 and a light source main body 53 and is attached to a light source attaching hole 54 provided in the substrate 15 in such a way that the lamp 51 faces to the back of the supporting portion 41. The lamp 51 is a lamp for night illumination.

The cover 13 is a plate-shaped member comprising an opening 55 and making up the outer shell on the front side of the switch structure while exposing the push portion 17 to the front side through the opening 55. Moreover, the cover 13 sandwiches the fixed end 23 together with the supporting portion 41 of the supporting member 7 and prevents the push button section 3 from dropping out of the cover 13.

To the substrate 15, the switch element 5 and the light source section 11 are attached, as described above.

Figure 5:
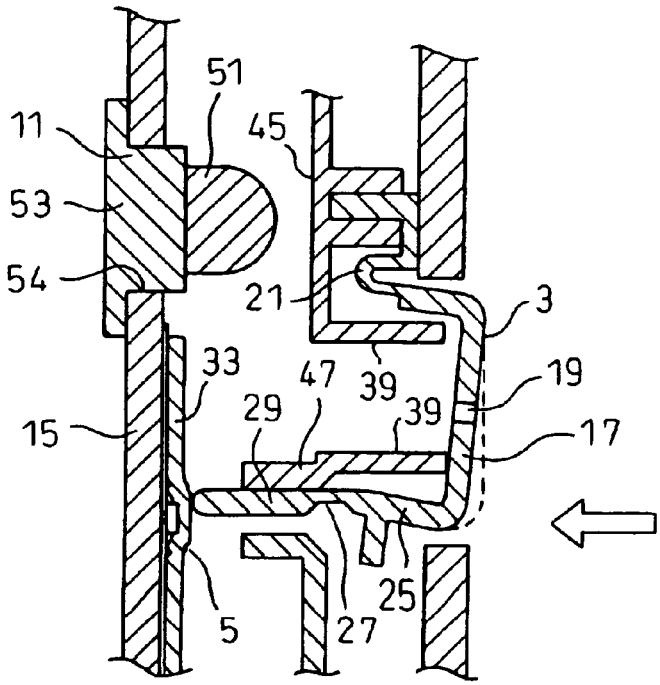
FIG. 5 is a diagram illustrating the operations of the switch structure in the first embodiment.

Next, the operations of the switch structure in the first embodiment are described with reference to FIG. 5.

When the push portion 17 is pushed in the direction of the arrow, the push button section 3 pivots clockwise about the hinge 21 as a center. At this time, in accordance with the pivot movement, the push rod section 25 tilts with respect to the internal guide plate 47.

When the push button section 3 pivots to a certain extent, a side of the contact portion 29 of the push rod section 25 comes into contact with the internal guide plate 47.

When the push button section 3 pivots further, as a force is exerted on the contact portion 29 from the internal guide plate 47, flexure is produced in the flexible portion 27 of the push rod section 25 and the contact portion 29 is brought into a state of being tightly pressed against the internal guide plate 47. At this time, as the internal guide plate 47 is perpendicular to the substrate 15, the contact portion 29 becomes also perpendicular to the substrate 15.

In addition, as the push button section 3 pivots, the contact portion 29 approaches the switch element 5 while sliding on the surface of the internal guide plate 47.

In other words, as the push button section 3 circularly moves, the contact portion 29 is guided along a certain path by the internal guide plate 47 and approaches the switch element 5 while maintaining the right angle with respect to the substrate 15.

The contact portion 29 of the push rod section 25 then pushes the center of the rubber section 33 of the switch element 5 and the on and off states of the switch element 5 are switched.

Next, the effects obtained from the switch structure in the first embodiment are described.

In the switch structure in the first embodiment, the contact portion 29 of the push rod section 25 is guided along a certain path by the internal guide plate 47 and pushes the center of the rubber section 33 while maintaining the right angle (in parallel to the direction of the movement of the switch element 5) with respect to the substrate 15. Therefore, according to the switch structure in the first embodiment, it is possible to securely turn on and off the switch element 5.

Moreover, as the contact portion 29 pushes the rubber section 33 of the switch element 5 from directly above, the entire surface of the rubber section 33 bends evenly and therefore excellent operability can be obtained.

In the switch structure in the first embodiment, as the push portion 17 and the push rod section 25 are formed integrally as the push button section 3, the manufacturing cost can be reduced compared to a case where they are manufactured separately. Moreover, as the push portion 17 and the push rod section 25 are formed integrally, it is unlikely that a sound of parts returning into place is produced and that the excellent feel of the switch structure is marred.

In the switch structure in the first embodiment, as the distance between the flexible portion 27 of the push rod section 25 and the substrate 15 is almost equal to the distance between the hinge 21 and the substrate 15, when the push button section 3 pivots, it is unlikely that the flexible portion 27 bends considerably (compared to a case where the difference in distance is larger). Due to this, the pivot movement of the push button section 3 does not require a large operating force and therefore excellent operability can be obtained.

Moreover, as the amount of flexure of the flexible portion 27 is small, it is unlikely that a large force is exerted on the flexible portion 27 and, therefore, the durability of the push rod section 25 is improved.

In the switch structure in the first embodiment, as the internal guide plate 47 is formed integrally as part of the supporting member 7, it is not necessary to provide the internal guide plate 47 as a separate part. Due to this, the manufacturing cost of the switch structure can be reduced.

In addition, in the switch structure in the first embodiment, the light from the light source section 11 is guided to the light transmitting section 19 of the push portion 17 by the scattering surface 45 or the reflecting surface 39 provided on the supporting member 7. Therefore, it is not necessary to provide a member to scatter or reflect the light from the light source section 11 as a separate part and, as a result, the manufacturing cost of the switch structure can be reduced.

Figure 6:
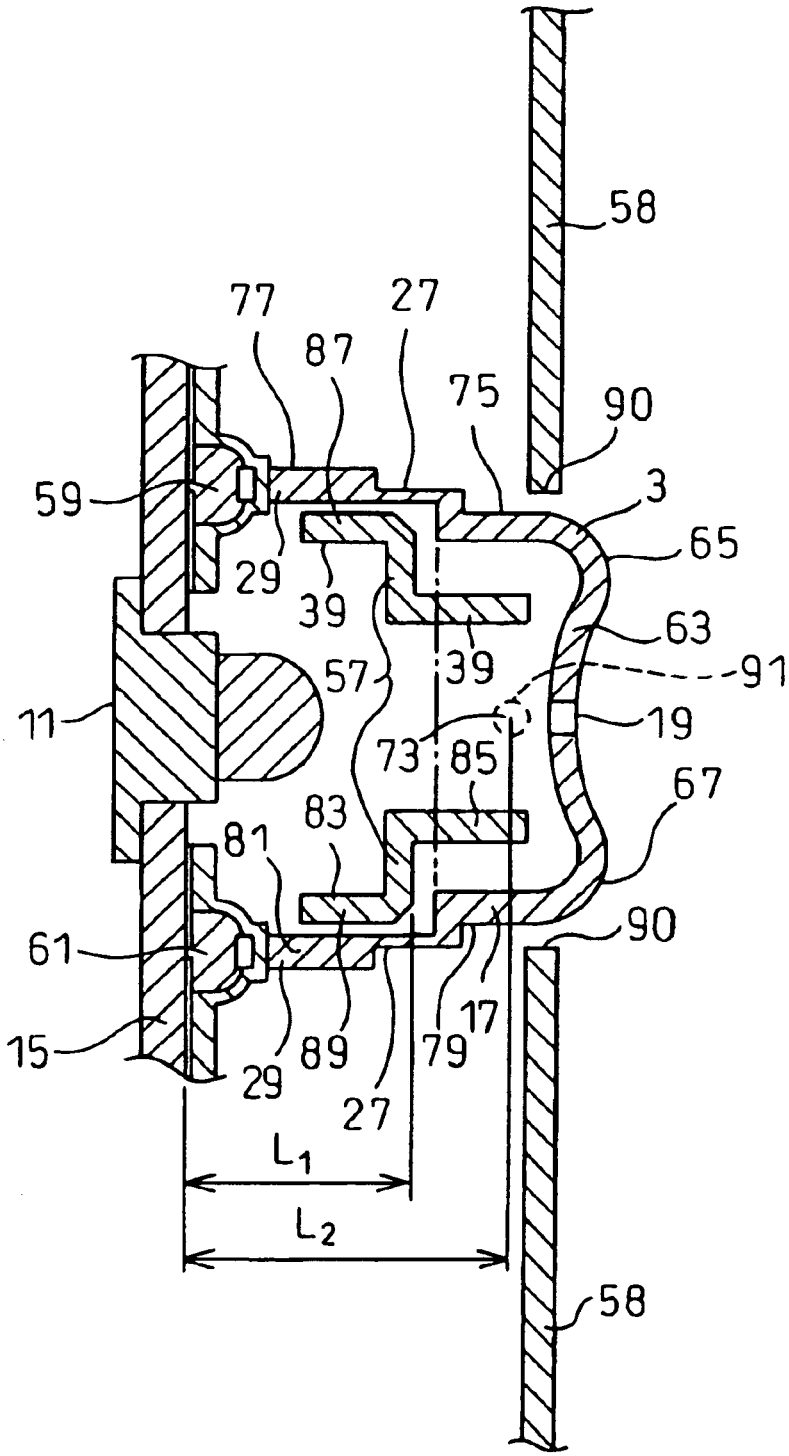
FIG. 6 is a diagram illustrating the structure of a switch structure in a second embodiment.
Figure 7:
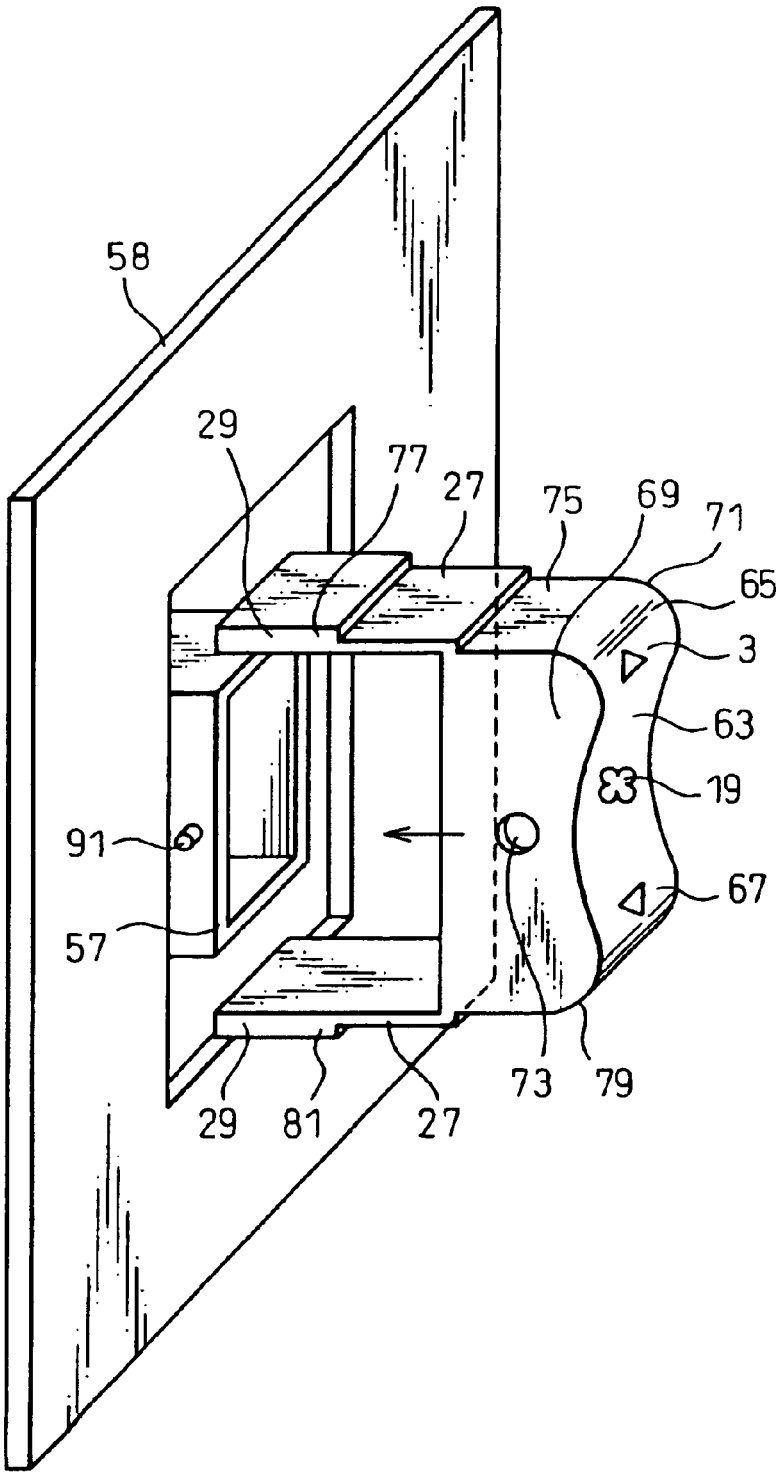
FIG. 7 is a diagram illustrating the structure of the switch structure in the second embodiment.

The configuration of the switch structure in the second embodiment is described with reference to FIG. 6 and FIG. 7. FIG. 6 is a sectional side elevation of the switch structure and FIG. 7 is a perspective view of the switch structure. The same parts as those in the first embodiment are not described here.

The switch structure in the second embodiment comprises the push button section 3 that pivots when pushed, an internal guide section 57 that guides the movement of the push button section 3, a case 58 that is the body of the switch structure, an upper side switch element 59 (switch element A) and a lower side switch element 61 (switch element B), that is, a pair of switches to be turned on and off by the push button section 3, the light source section 11 that illuminates the push button section 3, and the substrate 15 that supports the upper side switch element 59, the lower side switch element 61 and the light source section 11.

The push button section 3 has the box-shaped push portion 17. A surface portion 63, which is the front side surface (right-hand side in FIG. 6) of the push portion 17, is formed so that its central area is slightly hollowed and comprises an upper side convex portion 65, which is a convex portion located at the upper side of the surface portion 63, and a lower side convex portion 67, which is a convex portion located at the lower side of the surface portion 63.

In a left-hand side surface 69, which is the left-hand side (front side in FIG. 7) of the push portion 17, and in a right-hand side surface 71, which is the right-hand side of the push portion 17, shaft bearing holes 73 into which pivot shafts 91, which will be described later, are inserted, are provided respectively.

In addition, from the end of an upper side surface 75, which is the upper side (upper side in FIG. 7) of the push portion 17, an upper side push rod section 77 (push rod section A), which is a plate-shaped member, is provided extendedly in the direction perpendicular to the substrate 15, and from the end of a lower side surface 79, which is the lower side of the push portion 17, a lower side push rod section 81 (push rod section B), which is a similar plate-shaped member, is provided extendedly in the direction perpendicular to the substrate 15.

The upper side push rod section 77 and the lower side push rod section 81 are provided with the flexible portion 27, respectively, the rigidity of which is reduced by decreasing the thickness to a smaller value than that of the surroundings. The distance L1 (refer to FIG. 6) between the flexible section 27 and the substrate 15 is set to a value nearly equal to the distance L2 between the pivot shaft 91 and the substrate 15 (for example, the ratio L1/L2 is 0.95 to 1.05). In addition, the contact portions 29, which are the tips of the upper side push rod section 77 and the lower side push rod section 81, are arranged in parallel to the internal guide section 57 at certain intervals, as will be described later.

Moreover, the push portion 17 comprises the light transmitting section 19, which is a window that allows the light from the light source section 11 to pass through, on its front side (right-hand side in FIG. 6).

The internal guide section 57 is a cylindrical member, the sectional view of which is rectangular, and is contained inside of the push button section 3. The internal guide section 57 has a two-section structure composed of a large width section 83, which is near the substrate 15 and the width of which is great, and a narrow width section 85, which is near the front side and the width of which is narrow. In the large width section 83, an upper side guide surface 87 (a guide section on which a pushing force is exerted by the push rod section when the push button section is pushed), which is the upper side surface, and a lower side guide surface 89 (a guide section on which a pushing force is exerted by the push rod section when the push button section is pushed), which is the lower side surface, are perpendicular to the substrate 15, respectively, and are arranged in parallel to the contact portion 29 of the push rod section 25 at certain intervals.

In addition, the cylindrical pivot shaft 91 protrudes in parallel to the substrate 15 from the front side and the backside (the front side and backside in FIG. 7) of the internal guide section 57, respectively. The pivot shaft 91 is supported by the shaft bearing hole 73 in the push button section 3.

Moreover, on the inner surface of the internal guide section 57, the reflecting surface 39 is provided, which reflects the light from the light source section 11.

The case 58 is a rectangular plate-shaped member and has an opening 90, which is a rectangular window, in the center. The case 58 covers the front side of the switch structure while exposing the push portion 17 of the push button section to the outside through an opening 90.

The upper side switch element 59 is provided on the extension line of the upper side push rod section 77 on the substrate 15, and the lower side switch element 61 is provided on the extension line of the lower side push rod section 81 on the substrate 15.

The upper side switch element 59 and the lower side switch element 61 have a structure similar to that of the switch element 5 in the first embodiment.

The light source section 11 has a structure similar to that in the first embodiment and is attached to the substrate 15 so that the lamp 51 faces to the center of the push button section 3.

As described above, the upper side switch element 59, the lower side element 61 and the light source section 11 are attached to the substrate 15.

Figure 8:
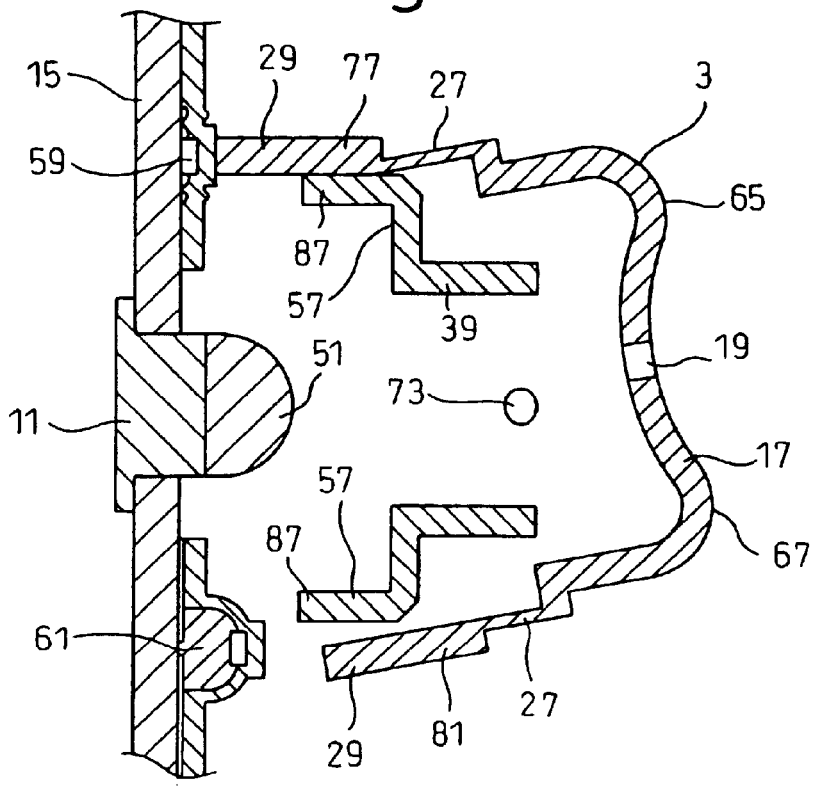
FIG. 8 is a diagram illustrating the operations of the switch structure in the second embodiment.
Figure 9:
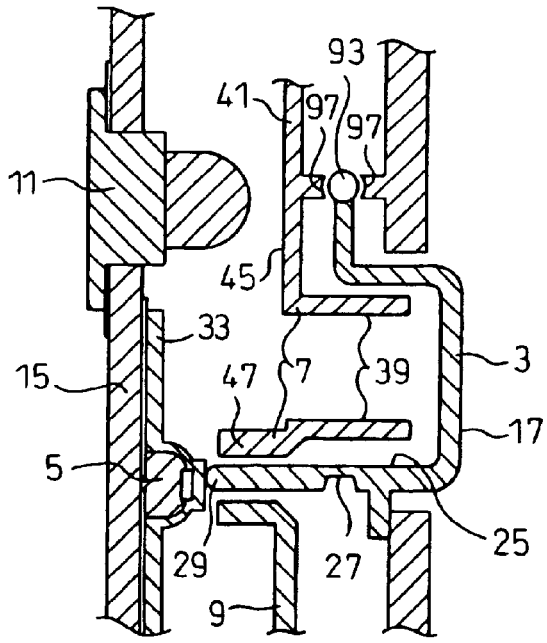
FIG. 9 is a diagram illustrating the structure of a switch structure in a third embodiment.

Next, the operations of the switch structure in the second embodiment are described with reference to FIG. 8.

When the upper side convex portion 65 of the push button section 3 is pushed, the push button section 3 pivots counterclockwise about the pivot shaft 91, as a center, which makes up a supporting member. As a result, the contact portion 29 of the upper side push rod section 77 comes into contact with the upper side guide surface 87 of the internal guide 57 and comes into close contact with the upper side guide surface 87 by means of the flexure of the flexible portion 27. The upper side guide surface 87 is, as described above, perpendicular to the substrate 15, therefore, the contact portion 29 also becomes perpendicular to the substrate 15.

Moreover, as the push button section 3 pivots counterclockwise, the upper contact portion 29 of the upper side push rod section 77 moves toward the center of the upper side switch element 59.

In other words, as the push button section 3 pivots counterclockwise, the contact portion 29 of the upper side push rod section 77 is guided by the upper side guide surface 87 and approaches the center of the upper side switch element 59, in the state of being perpendicular to the substrate 15.

When the center of the upper side switch element 59 is pushed by the contact portion 29, the on and off states of the upper side switch element 59 are switched.

When the lower side convex portion 67 of the push button section 3 is pushed, the push button section 3 pivots clockwise about the pivot shaft of 91 as a center and the on and off states of the lower side switch element 61 are switched by the contact portion 29 of the lower side push rod section 81, as is similar to the above.

Next, the effects obtained from the switch structure in the second embodiment are described.

According to the switch structure in the second embodiment, when the upper side convex portion 65 is pushed, the contact portion 29 of the upper push rod section 77 is guided along a fixed path by the internal guide section 57 and, as a result, pushes the center of the rubber portion of the upper side switch element 59, with the right angle with respect to the substrate 15 (in parallel to the direction of movement of the upper side switch) being maintained. Therefore, according to the switch structure in the second embodiment, the upper side switch element 59 can securely be turned on and off. Similarly, when the lower side convex portion 67 is pushed, the lower side switch element 61 can surely be turned on and off.

Moreover, according to the second embodiment, as the contact portion 29 pushes the center of the rubber section of the upper side switch element 59 and the lower side switch element 61 directly from above, the entire surface of the rubber section bends evenly and therefore the excellent operability can be obtained.

According to the switch structure in the second embodiment, as the push portion 17, the upper side push rod section 77 and the lower side push rod section 81 are formed integrally as the one-piece push button section 3, the manufacturing cost can be reduced compared to a case where they are manufactured separately. Moreover, it is unlikely that a sound of parts returning into place is produced between the push portion 17 and the upper side push rod section 77 or between the push portion 17 and the lower side push rod section 81, and that the excellent feel is marred.

According to the switch structure in the second embodiment, as the distance between the flexible portion 27 of the upper side push rod section 77 and the substrate 15, and the distance between the flexible portion 27 of the lower side push rod section 81 and the substrate 15, are almost equal to the distance between the pivot shaft 91 of the push button section 3 and the substrate 15, respectively, it is unlikely that the flexible portion 27 bends considerably (compared to a case where the flexible portion 27 is provided nearer to the substrate 15) when the push button section 3 pivots. Due to this, the pivot movement of the push button section 3 does not require a large operating force, resulting in excellent operability.

Moreover, as the amount of flexure of the flexible portion 27 is small, it is unlikely that a large stress is exerted on the flexible portion 27 and therefore the durability of the push rod section 25 is improved.

According to the switch structure in the second embodiment, the light from the light source section 11 is guided to the light transmitting section 19 of the push portion 17 by the reflecting surface 39 provided to the internal guide section 57. Therefore, it is not necessary to provide a member to reflect the light from the light source section 11 as a separate part, and as a result, the manufacturing cost of the switch structure can be reduced.

According to the switch structure in the second embodiment, when the push button section 3 pivots, only the upper side guide surface 87 comes into contact with the upper side push rod section 77 and guides its operation and, therefore, it is unlikely that a large frictional force is exerted on the upper side push rod section 77. Similarly, it is unlikely that a large frictional force is exerted on the lower side push rod section 81.

Therefore, the switch structure in the second embodiment can operate smoothly.

According to the switch structure in the second embodiment, as the two switches can be turned on and off, the manufacturing cost can be reduced compared to a case where two switch structures are provided. Moreover, the space where the switch structure is installed can be reduced.

Basically, the switch structure in the third embodiment has a structure almost the same as that of the switch structure in the first embodiment.

According to the switch structure in the third embodiment, however, the push button section 3 comprises a pivot shaft 93 above the push portion 17. The supporting member 7 comprises a shaft bearing portion 97 that supports the pivot shaft 93 while allowing a pivot movement. Therefore, when the push portion 17 is pushed, the push button section 3 can pivot about the pivot shaft 93 as a center.

The switch structure in the third embodiment has the same effects as the switch structure in the first embodiment.

The configuration of the switch structure in the fourth embodiment is described with reference to FIG. 10.

Figure 10:
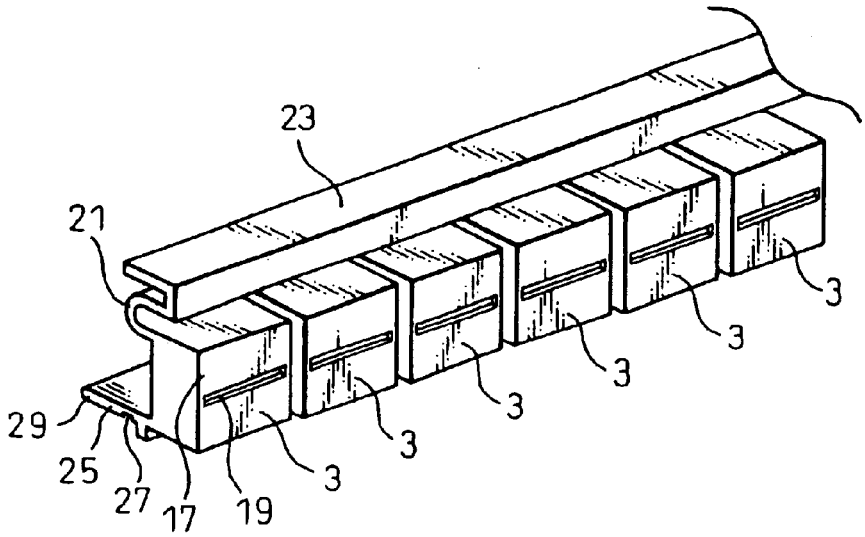
FIG. 10 is a diagram illustrating the structure of a switch structure in a fourth embodiment.

The switch structure in the fourth embodiment comprises a plurality of the push button sections 3 as shown in FIG. 10, and these push button sections 3 are connected to each another by sharing the fixed ends 23. Each individual push button section 3 has a structure similar to that of the push button section 3 in the first embodiment except for the fixed end 23.

According to the switch structure in the fourth embodiment, basically similar to the first embodiment shown in FIG. 2, there are arranged the supporting member 7, the external guide section 9 and the switch element 5 so as to correspond to each push button section 3, respectively. Among these, the supporting members 7 are connected to each another at the part of the supporting portion 41 and formed integrally, with the guide section 9 also being formed integrally.

In other words, the configuration of the switch structure in the fourth embodiment is one made up by aligning the switch structures in the first embodiment in the direction perpendicular to the plane of the page including FIG. 2 and connecting them to each another at the fixed ends 23 of the push button sections 3, the supporting portions 41 of the supporting members 7, and the guide sections 9.

Moreover, the switch structure in the fourth embodiment comprises the light source section 11, which supplies light to each individual push button sections 3.

The effects of the switch structure in the fourth embodiment are described below.

The switch structure in the fourth embodiment has the same effects as the switch structure in the first embodiment.

In the switch structure in the fourth embodiment, the plurality of push button sections 3 are connected via the common fixed end 23.

Therefore, according to the switch structure in the fourth embodiment, it is possible to install the connected push button sections 3 at a time when manufacturing, and as a result, manufacturing is easy.

According to the switch structure in the fourth embodiment, the supporting member 7 and the guide section 9 are formed integrally, and the light source section 11 is shared, therefore, the number of parts can be reduced.

Next, the fifth embodiment is described. Basically, the switch structure in the fifth embodiment has a structure similar to that of the switch structure in the fourth embodiment.

Figure 11:
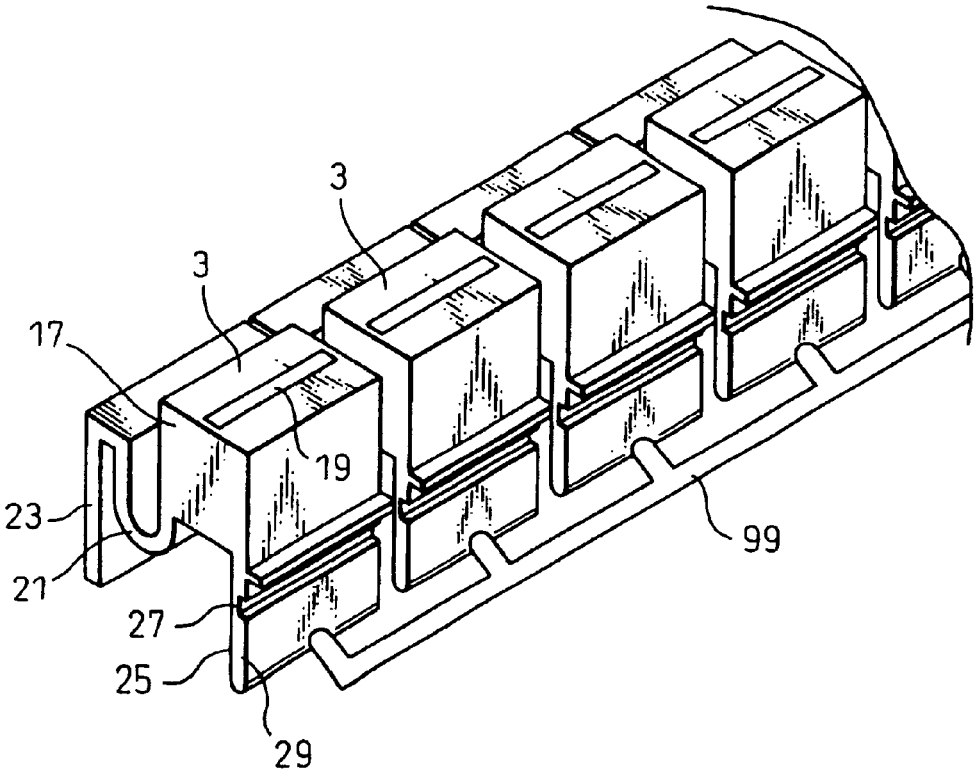
FIG. 11 is a diagram illustrating the structure of a switch structure in a fifth embodiment.

In the switch structure in the fifth embodiment, however, a liner 99 is provided between the plurality of the push rod sections of the push button sections to connect them as shown in FIG. 11.

In other words, the configuration of the switch structure in the fifth embodiment is one made up by aligning the switch structures in the first embodiment in the direction perpendicular to the plane of the page including FIG. 2 and by connecting the push button sections 3 to each another by the liner 99.

The switch structure in the fifth embodiment has the same effects as the switch structure in the fourth embodiment shown in FIG. 10.

While the invention has been described by reference to specific embodiments chosen for purposes of illustration, it should be apparent that numerous modifications could be made thereto by those skilled in the art without departing from the basic concept and scope of the invention.

What is claimed is:

1. A switch structure comprising a switch element (5, 59, 61) performing circuit switching operation by a push and a push button section (3) attached rotationally movably to a supporting member (7, 91) and having a push rod section (25, 77, 81) pushing the switch element and integrally formed thereto, wherein a switching operation is performed when the push button section (3) is rotationally moved by pushing and the push rod section pushes the switch element, wherein the push rod section is provided with a flexible portion (27) able to bend when pushed, and wherein a guide section (47, 57, 49) is provided which comes into contact with the push rod section to bend the flexible portion and, at the same time, guides the push rod section to push the switch element in the normal direction when the push button section is rotationally moved by pushing.

2. A switch structure, as set forth in claim 1, wherein the push button section (3) is attached to the supporting member (7) via a hinge (21).

3. A switch structure, as set forth in claim 2, wherein the distance between the hinge (21) and the switch element (5) is almost equal to the distance between the center of the flexible portion (27) and the switch element (5) in the pushing direction during the period of pushing.

4. A switch structure, as set forth in claim 1, wherein the push button section (3) is attached pivotally to the supporting member (7) via a pivot shaft (91).

5. A switch structure, as set forth in claim 4, wherein the distance between the pivot shaft (91) and the switch element (5) is almost equal to the distance between the center of the flexible portion (27) and the switch element (5) in the pushing direction during the period of pushing.

6. A switch structure, as set forth in claim 1, wherein the cross-sectional area of the flexible portion (27) is less than that of the surrounding portion in the push rod section (25, 77, 81).

7. A switch structure, as set forth in claim 1, wherein the guide section (47, 57) is provided only on the side on which a pushing force is exerted by the push rod section during the period of pushing.

8. A switch structure, as set forth in claim 1, wherein the guide section (47, 57, 49) is provided on the side on which a pushing force is exerted by the push rod section during the period of pushing and, on the opposite side, with the push rod section (47, 57, 49) being sandwiched in between.

9. A switch structure, as set forth in claim 1, wherein the push button sections (3) are connected to each another and at the same time comprise a plurality of convex portions (65, 67) able to rotationally move independently, and wherein the switch element (59, 61) and the guide section (57) are provided corresponding to each individual convex portion (65, 67).

10. A switch structure, as set forth in claim 1, wherein a light source section (11) for illuminating the push button section (3) is comprised internally and, at the same time, wherein the guide section (47) comprises a reflecting surface (39) that reflects the illumination light from the light source section 11 onto the push button section (3).

11. A switch structure, as set forth in claim 1, wherein the supporting member (7) and the guide section (47) are formed integrally.

12. A switch structure, as set forth in claim 1, wherein a first switch element (59) and a second switch element (61) are comprised as the switch element (5) and, at the same time, wherein the push button section (3) comprises a first push rod section (77) that pushes the first switch element (59) and a second push rod section (81) that pushes the second switch element (61) as the push rod section, wherein the first push rod section (77) pushes the first switch element (59) when the push button section (3) rotationally moves to push the first switch element (59), and wherein the second push rod section (81) pushes the second switch element (61) when the push button section (3) rotationally moves to push the second switch element (61).

* * * * *